United States Patent [19]

Geil et al.

[11] 4,347,758

[45] Sep. 7, 1982

[54] MOLDED PLASTIC CONTROL LOCK KNOB

[75] Inventors: Ronald J. Geil, Vermilion; Richard E. Tinker, Westlake, both of Ohio; Robert A. Carmo, Placentia, Calif.

[73] Assignee: Gould Inc., Rolling Meadows, Ill.

[21] Appl. No.: 183,957

[22] Filed: Sep. 3, 1980

[51] Int. Cl.[3] ..... G05G 5/06

[52] U.S. Cl. ..... 74/531

[58] Field of Search ..... 74/531; 403/350, 351, 403/352, DIG. 8

[56] References Cited

U.S. PATENT DOCUMENTS

| | | | |
|---|---|---|---|
| 808,992 | 1/1906 | Lawson | 403/350 |
| 2,312,590 | 3/1943 | Reynolds . | |
| 2,509,058 | 5/1950 | Haury | 74/531 |
| 2,546,157 | 3/1951 | Hume . | |
| 2,871,044 | 1/1959 | Peterson et al. | |
| 3,053,110 | 9/1962 | Shalek | 74/531 |
| 3,289,137 | 11/1966 | Jones et al. | 74/531 |
| 3,292,956 | 12/1966 | Schiansky . | |
| 3,419,293 | 12/1968 | Conrad . | |
| 3,515,418 | 6/1970 | Neilsen . | |
| 3,773,371 | 11/1973 | Carlsson . | |
| 3,916,721 | 11/1975 | Egger . | |
| 3,924,957 | 12/1975 | Camosso . | |
| 4,036,079 | 7/1977 | Pratt | 74/531 |
| 4,154,125 | 5/1979 | Frank . | |
| 4,154,545 | 5/1979 | Pinto et al. | |

*Primary Examiner*—Peter M. Caun

*Attorney, Agent, or Firm*—E. E. Sachs; John R. Garrett

[57] ABSTRACT

A device is disclosed for use with adjustable rotary controls such as potentiometers to provide a means for locking the control knob and to provide varying amounts of drag force to aid in fine adjustments. A locking shoe assembly having integral locking shoes with cam surfaces is attached to the control panel with the rotary control shaft extending through its center. A locking knob with internal cams fits over the locking shoe assembly. A control knob with an integral land surface is attached to the rotary shaft, holds the locking knob in place and extends into the locking shoe assembly. Rotation of the locking knob engages the various cam surfaces thus binding the land surface and the control knob.

9 Claims, 7 Drawing Figures

MOLDED PLASTIC CONTROL LOCK KNOB

BACKGROUND OF THE INVENTION

It has been found desirable to have locking knobs on electrical instruments so as to prevent inadvertent adjusting once set and to avoid displacement caused by vibrations and the like. The prior art teaches several different devices that accomplish this purpose. Most of these devices are somewhat complicated in construction since they require many components to constitute the locking device. Because of the unnecessary complicated design of the prior locking devices, the assembly of such devices is more costly and time consuming than would be if the device had a minimal amount of components.

OBJECTS OF THE INVENTION

An object of the present invention is to provide a locking knob device for use with instruments that has but a few components.

Another object of the present invention is to provide a locking knob that will prevent inadvertent adjustments or motion of a control shaft of a rotary controlled device.

Still another object of the present invention is to provide complete locking or unlocking of the movement of a control knob without affecting the set position of the knob.

The above objects are given by way of example, thus other desirable objectives and advantgages achieved by the present invention may occur to those skilled in the art. The scope of the invention is to be limited only by the appended claims.

BRIEF SUMMARY OF THE INVENTION

The above objects and other advantages are achieved by the present invention. A locking control knob is provided for use with rotary control devices. The rotary control devide is mounted through a panel and is retained with a suitable nut. A locking shoe assembly having a corresponding cavity therein is press-fitted over the nut. This prevents the locking shoe assembly from rotating. The locking shoe assembly has a plurality of integral locking shoes extending therefrom. A locking knob is then slid over the locking shoe assembly. A control knob is then slipped onto the shaft of the rotary control device so that the control knob land extends through the locking knob and is inside the plurality of locking shoes. Set screws on the locking knob are then tightened to secure the knob to the control shaft. The locking knob is retained by a raised external knurl on the control knob. Locking is accomplished by rotating the locking knob, internal cams therein being forced against the integral locking shoes of the locking shoe assembly, thus bringing the locking shoes to bear upon the control knob land, thereby preventing the control knob from turning.

DESCRIPTION OF THE PREFERRED EMBODIMENTS

Figure 1:
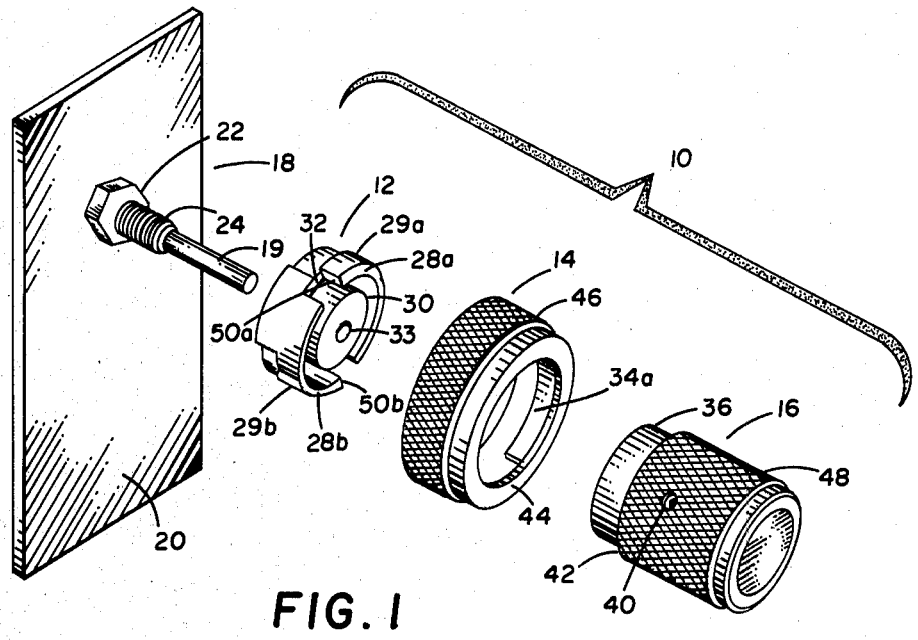
FIG. 1 is an exploded perspective view of the present invention.

A description of the invention follows referring to the drawings in which like reference numerals denote like elements of structure in each of the several Figures.

Figure 2:
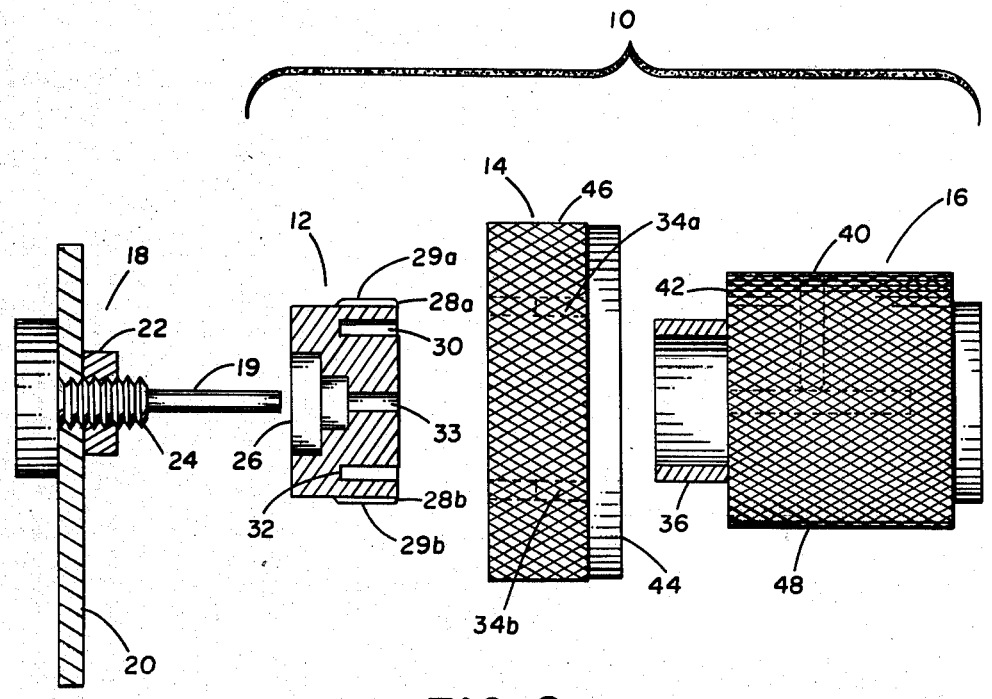
FIG. 2 is an exploded partial section view of the present invention.
Figure 5:
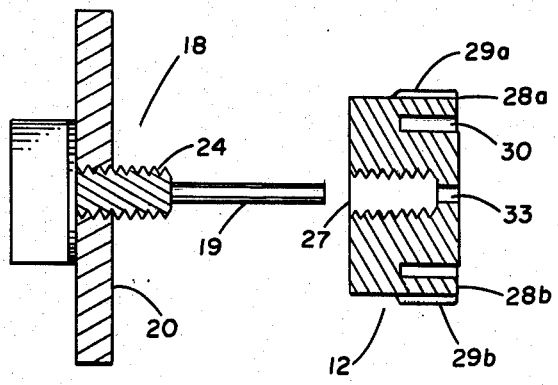
FIG. 5 is an exploded partial section of the panel and the locking shoe assembly according to another embodiment of the present invention.

The locking device 10 of the present invention is shown in FIGS. 1 and 2 having a molded locking shoe assembly 12, a locking knob 14 and a control knob 16. A rotary control device 18 having a rotary control shaft 19, such as a potentiometer, is mounted through a panel 20 and is fixedly attached thereto by a nut 22 tightened over the rotary control threads 24. The molded locking shoe assembly 12 has an internal cavity 26 being of proximate dimension to fit tightly over nut 22. Although the molded locking shoe assembly 12 may be press-fitted over nut 22, other methods of fixedly attaching the molded locking shoe assembly 12 to the rotary control device 18 may be used such as bonding the molded locking shoe shoe assembly 12 to the control panel 20 with a suitable adhesive material such as epoxy or the like. FIG. 5 shows another embodiment of the present invention in which the rotary control device 18 is fixedly attached to panel 20 by locking shoe assembly 12 which has a threaded cavity 27 to screw onto rotary control threads 24.

Figure 3:
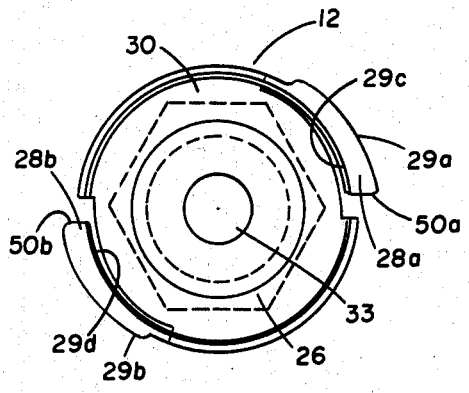
FIG. 3 is a top planar view of the locking shoe asembly of the present invention.
Figure 4:
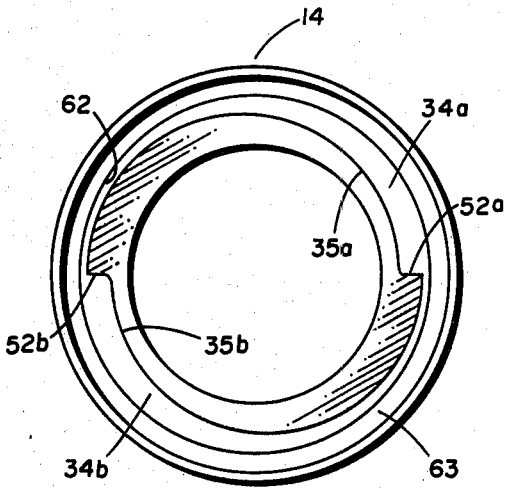
FIG. 4 is a bottom planar view of the locking knob of the present invention.

The molded locking shoe assembly is preferably molded from plastic and as can be seen in FIG. 3 has preferably two locking shoes **28*a* and 28*b* cylindrically extending therefrom and integrally attached at one end with externally inclined surfaces 29*a* and 29*b* and inner surfaces 29*c* and 29*d*. The molded locking shoe assembly 12 has a circumferential receiving slot 30 with a shoulder 32. The purpose of circumferential receiving slot 30 is to receive the control knob 16. Through bore 33 is dimensioned slightly larger than the diameter of shaft 19 so as to permit free rotation thereof. Control locking knob 14, as can be seen in FIG. 4, preferably has two internal integral cams 34*a* and 34*b* in the same direction as surfaces 29*a* and 29*b*. The locking knob 14 is placed axially over molded locking shoe assembly 12. The internal integral locking cams 34*a* and 34*b* of locking knob 14 are dimensioned so as to be in close promixity with the integral locking shoes 28*a* and 28*b* of molded locking shoe assembly 12 in the unlocked position. Control locking knob 16 has a land portion 36 of such dimension as to fit within central recess area 30 and to be in proximity with the integral locking shoes 28*a* and 28*b***.

The preferred embodiment of the present invention contemplates attaching control knob 16 to rotary shaft 19 by means of set screw 40. Other means of attachment are also contemplated, such as epoxying, etc. Control knob 16 has a retention surface 42 dimensioned such that it engages surface 44 of locking knob 14 such that locking knob 14 is held in longitudinal position but is free to rotate about the axis of the rotary control shaft 19. Both locking knob 14 and control knob 16 have outer knurled grasping surfaces 46 and 48, respectively, which facilitate movement of the knobs by an operator.

Locking shoes 28*a* and 28*b* have stop surfaces 50*a* and 50*b* at the distal other end, respectively, and locking cams 34*a* and 34*b* have stop surfaces 52*a* and 52*b*, respectively. These surfaces of the locking shoes and the locking cams come together at the fully unlocked position, i.e. little or no force is being exerted by the locking cams against the locking shoes.

Turning to the operation of the present invention, in the unlocked position there is no physical contact between cams 34*a* and 34*b*, locking shoes 28*a* and 28*b* or land 36 so that control knob 16 is free to rotate in either direction, thereby rotating shaft 19 of rotary control device 18. To achieve the locking, locking knob 14 is rotated in the direction opposite that of the internal incline of the integral cams 34*a* and 34*b* such that the internal cams 34*a* and 34*b* engage the integral locking shoes 28*a* and 28*b* of molded locking shoe assembly 12. Maximum lock of control knob 16 occurs in less than a 180° turn of locking knob 14 from the fully unlocked position. The distal other end of molded locking shoes 28*a* and 28*b* are thus forced radially inward, forcing the inner surfaces 29*c* and 29*d* to come in contact with land portion 36 of control locking knob 16, thus locking the control knob 16 in position. To unlock the device the locking knob 14 is rotated in the same direction as that of the internal incline surface of locking cams 34*a* and 34*b* so as to disengage the locking cams 34*a* and 34*b* from the molded locking shoes 28*a* and 28*b* permitting them to return back to their original position thus freeing control knob 16.

Figure 6:
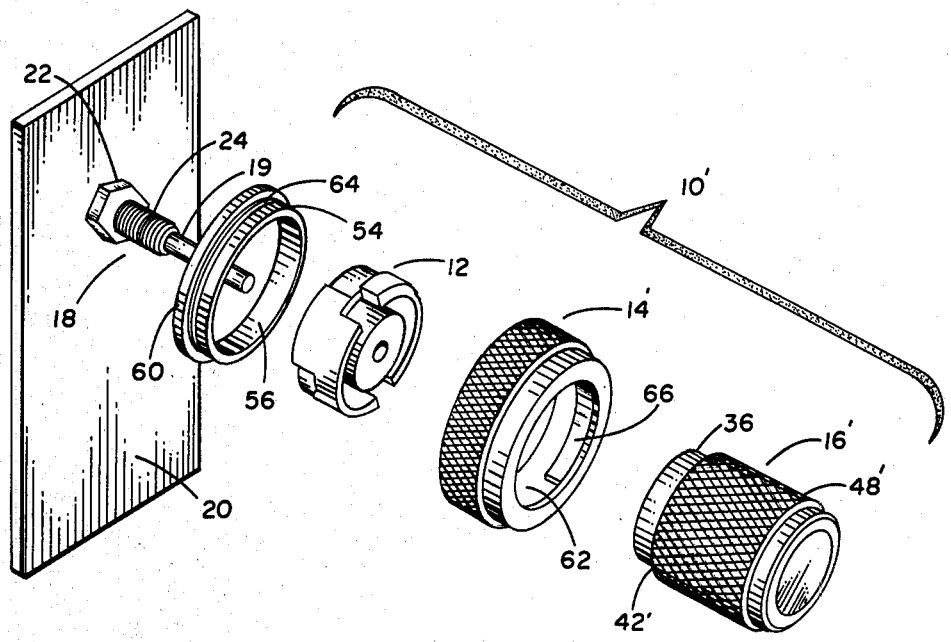
FIG. 6 is an exploded perspective view of yet another embodiment of the present invention.
Figure 7:
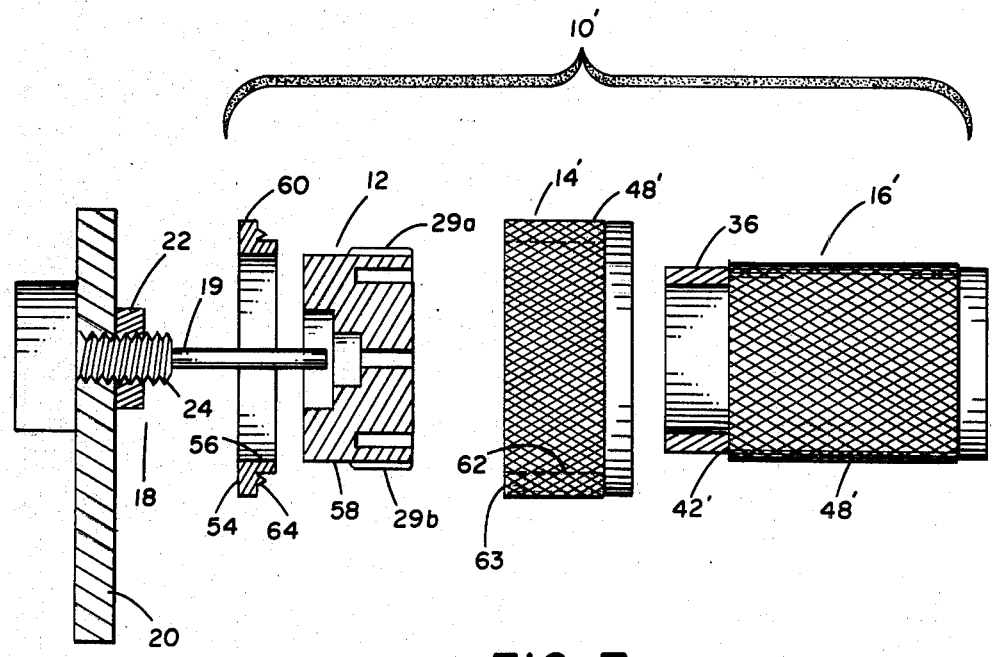
FIG. 7 is an exploded partial section view of the embodiment of the present invention shown in FIG. 6.

It is also possible to have a finite amount of drag force while adjusting rotary control 18. This can be accomplished by rotating locking knob 14 only sufficiently enough to cause cams 34 to force shoes 28 into slight engagement with land 36 until the amount of drag force required is achieved. A finite amount of rotational drag force on the rotary control will aid an operator in making fine adjustments. Another embodiment of the present invention, shown in FIGS. 6 and 7, contemplates a rotary control device that not only has a rotational control function but a push and/or pull function. In order to facilitate the in and out motion of the control knob, a different means for retaining the locking knob must be provided to hold the locking knob in a longitudinal, stationary position with respect to the mounting panel 20 other than surface 42 as discussed above. Turning now to the embodiment shown in FIGS. 6 and 7, the locking device 10' has an annular retention ring 54, a molded locking shoe assembly 12, a locking knob 14' and a control knob 16'. The inner surface 56 of annular retention ring 54 is dimensioned so as to fit over surface 58 of molded locking shoe assembly 12 but not over cam surfaces 29*a* and 29*b* and to be able to rotate freely about molded locking shoe assembly 12. The outer surface surface 60 of annular retention ring 54 is perferably the same dimension as the outer knurled surface 48' of locking ring 14'. Outer surface 61 of annular retention ring 54 is preferably dimensioned so as to fit snugly within the inner surface 62 of locking knob 14'. The function of locking knob 14' is the same as that of locking knob 14 described above. Annular retention ring 54 and locking ring 14' are fixedly attached together at surface 63 of locking knob 14'. In one embodiment, the annular retention ring 54 and locking knob 14' are ultrasonically welded together. An energy director surface 64 is provided, as is known in the art, for the ultrasonic welding purpose. When annular retention ring 50 is fixedly attached to locking ring 14' and when locking shoe assembly 12 is fixedly attached to the panel 20 and rotary control device 18, the locking ring 14' will be held relatively fixed in a longitudinal axis with respect to panel 20. The annular locking ring 54 takes the functional place of the surface 42 in the embodiment of the present invention shown in FIGS. 1 and 2 in holding the locking knob 14/14' in a relatively fixed longitudinal position. Since the control knob 16' is no longer required for retaining locking knob 14', is can be fixedly attached to rotary control shaft 19 to not only provide rotational motion thereof, but to provide a push and/or pull motion along the longitudinal axes of the rotary control device when the locking knob 14' is in the unlocked position. The surface 42' and the knurled surface 48' of control knob 16' are dimensioned such as to fit within the inner diameter 66 of locking knob 14'. The control knob 16' is mounted on shaft 19 such that control knob 16' can move in and/or out and still remain with the circumferential receiving slot 30 of molding locking shoe assembly 12.

We claim:

1. A locking device for use with an adjustable rotary control member of the type having a rotary shaft fixedly mounted through a panel, said locking device comprising:

a locking shoe assembly having a means for fixedly attaching said locking shoe assembly to said panel so as to remain rotationally fixed thereto wherein the rotary shaft extends axially through said locking shoe assembly, a circumferential receiving slot, and at least one locking shoe integrally attached at one end to said locking shoe assembly with an internally inclining outer cam surface wherein the distal other end of said locking shoe is free to move radially inward into said receiving when force is applied thereto;

an annular locking knob circumferentially mounted over said locking shoe assembly so that said shaft of said rotary control member is in axial alignment and extends through said locking knob and wherein said locking knob is free to move rotationally about said locking shoe assembly, said locking knob having at least one internally inclining internal cam being dimensioned so as to be closely adjacent with said internally inclining outer cam of said locking shoe when said locking knob is in an unlocked position and adapted to contact said internally inclined outer cam of said locking shoe when said locking knob is rotated into a locked position forcing the free end of said locking shoe into said receiving means; and a control knob mounted on said shaft of said rotary control device, said control knob having an attachment means for attaching said control knob to said shaft of said rotary control member so that rotation of the control knob will rotate said shaft of said rotary control device, a land portion integrally attached to said knob and adapted to fit within said circumferential receiving slot of said locking shoe assembly, an integral retention means for retaining said locking knob in a longitudinal position with respect to said panel and said locking shoe assembly while permitting said locking knob to rotate about said locking shoe assembly so that when said locking knob is in siad unlocked position said control knob is free to rotate and when said locking knob is in said locked position said at least one locking knob internal cam forces said at least one locking shoe into said receiving slot binding said land portion in said receiving slot thus preventing said control knob from being rotated.

2. The locking device of claim 1 wherein said annular locking knob has a knurled outer surface.

3. The locking device of claim 1 wherein said control knob has a knurled outer surface.

4. The locking device of claim 1 wherein said means for fixedly attaching said locking shoe assembly to said panel is a hex nut receiving socket.

5. The locking device of claim 1 wherein said means for fixedly attaching said locking shoe assembly to said panel is a threaded receiving bore.

6. The locking device of claim 1 wherein said annular locking knob will fully bind said control knob in less than a 180° turn of said annular locking knob.

7. The locking device of claim 1 wherein said locking shoe assembly is made from molded plastic.

8. The locking device of claim 1 wherein said retention means for retaining said locking knob in a longitudinal position with respect to said panel is an annular raised surface of sufficient dimension and in such location on said control knob to retain said annular locking knob.

9. A locking device for use with an adjustable rotary control member of the type having a rotary shaft fixedly mounted through a panel, said locking device comprising:

a locking shoe assembly having a means for fixedly attaching said locking shoe assembly to said panel so as to remain rotationally fixed thereto wherein the rotary shaft extends axially through said locking shoe assembly, a circumferential receiving slot, and two locking shoes, each integrally attached at one end to said locking shoe assembly diametrically opposite one another, each with an internally inclining outer cam surface wherein the distal other ends of said locking shoes are free to move radially inward into said receiving slot when force is applied thereto;

an annular locking knob circumferentially mounted over said locking shoe assembly so that said shaft of said rotary control member is in axial alignment and extends through said locking knob and wherein said locking knob is free to move rotationally about said locking shoe assembly, said locking knob having two internally inclining internal cams diametrically opposite one another and being dimensioned so as to be closely adjacent with said internally inclining outer cams of said locking shoes when said locking knob is in an unlocked position and adapted to contact said internally inclined outer cams of said locking shoes when said locking knob is rotated into a locked position forcing the free ends of said locking shoes into said receiving means; and a control knob mounted on said shaft of said rotary control device, said control knob having an attachment means for attaching said control knob to said shaft of said rotary control member so that rotation of the control knob will rotate said shaft of said rotary control device, a land portion integrally attached to said knob and adapted to fit within said circumferential receiving slot of said locking shoe assembly, an integral retention means for retaining said locking knob in a longitudinal position with repect to said panel and said locking shoe assembly while permitting said locking knob to rotate about said locking shoe assembly, so that when said locking knob is in said unlocked position, said control knob is free to rotate and when said locking knob is in said locked position said locking knob internal cams force said locking shoes into said receiving slot binding said land portion in said receiving slot, thus preventing said control knob from being rotated.

* * * * *

UNITED STATES PATENT AND TRADEMARK OFFICE

CERTIFICATE OF CORRECTION

PATENT NO. : 4,347,758

DATED : September 28,1982

INVENTOR(S) : R.J.Geil, R.E.Tinker, R.A.Carmo

It is certified that error appears in the above-identified patent and that said Letters Patent are hereby corrected as shown below:

In column 1, line 42, please change "devide" to --device--; and

In column 2, line 29, please delete "shoe", first occurrence; and

In column 3, line 57, please delete "surface", first occurrence; and

In column 4, line 11, please change "is" to --it--.

In column 4, line 37, please insert "slot" after the word "receiving".

In column 4, line 66, please change "siad" to --said--.

Signed and Sealed this

Twenty-third Day of November 1982

[SEAL]

Attest:

GERALD J. MOSSINGHOFF

Attesting Officer

Commissioner of Patents and Trademarks